US008490547B1

(12) United States Patent
Rastegar

(10) Patent No.: US 8,490,547 B1
(45) **Date of Patent: *Jul. 23, 2013**

(54) METHODS AND DEVICES FOR ENABLING SAFE/ARM FUNCTIONALITY WITHIN GRAVITY DROPPED SMALL WEAPONS RESULTING FROM A RELATIVE MOVEMENT BETWEEN THE WEAPON AND A RACK MOUNT

(75) Inventor: Jahangir S Rastegar, Stony Brook, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/589,123

(22) Filed: Aug. 18, 2012

Related U.S. Application Data

(62) Division of application No. 12/606,893, filed on Oct. 27, 2009, now Pat. No. 8,245,641.

(60) Provisional application No. 61/109,153, filed on Oct. 28, 2008.

(51) Int. Cl.
*F42C 11/00* (2006.01)
*F42C 15/40* (2006.01)

(52) U.S. Cl.
USPC ..... 102/207; 102/210; 102/247

(58) Field of Classification Search
USPC ..... 102/207, 210, 247, 275.11, 262
See application file for complete search history.

(56) References Cited

U.S. PATENT DOCUMENTS

| | | | | |
|---|---|---|---|---|
| 2,987,998 | A * | 6/1961 | Booth | 102/210 |
| 3,356,026 | A * | 12/1967 | Lubig | 102/210 |
| 3,604,357 | A * | 9/1971 | Duncan | 102/229 |
| 5,022,324 | A * | 6/1991 | Rice, Jr. | 102/201 |
| 7,312,557 | B2 * | 12/2007 | Rastegar et al. | 310/339 |
| 7,437,995 | B2 * | 10/2008 | Rastegar et al. | 102/216 |
| 7,506,586 | B1 * | 3/2009 | Pereira et al. | 102/207 |
| 7,587,979 | B2 * | 9/2009 | Rastegar et al. | 102/247 |
| 7,587,980 | B2 * | 9/2009 | Rastegar et al. | 102/253 |
| 7,610,841 | B2 * | 11/2009 | Padan | 89/1.815 |
| 7,690,304 | B2 * | 4/2010 | Roemerman et al. | 102/222 |
| 7,762,191 | B2 * | 7/2010 | Rastegar et al. | 102/210 |
| 7,762,192 | B2 * | 7/2010 | Rastegar et al. | 102/210 |
| 8,245,641 | B2 * | 8/2012 | Rastegar | 102/207 |
| 2007/0204756 | A1 * | 9/2007 | Rastegar et al. | 102/210 |
| 2010/0236440 | A1 * | 9/2010 | Rastegar | 102/209 |
| 2010/0251879 | A1 * | 10/2010 | Rastegar et al. | 86/50 |
| 2011/0168046 | A1 * | 7/2011 | Rastegar et al. | 102/210 |
| 2011/0252994 | A1 * | 10/2011 | Murray et al. | 102/215 |

* cited by examiner

*Primary Examiner* — Michael David

(57) ABSTRACT

A device for enabling safe/arm functionality in a gravity dropped weapon. The device including: a rack for attaching the weapon to an airframe; an elastic element disposed in the weapon; a releasable connection between the weapon and the airframe to release a stored energy in the elastic element; and a piezoelectric member connected to one end of the elastic member for converting the stored energy to an electrical energy.

8 Claims, 12 Drawing Sheets

METHODS AND DEVICES FOR ENABLING SAFE/ARM FUNCTIONALITY WITHIN GRAVITY DROPPED SMALL WEAPONS RESULTING FROM A RELATIVE MOVEMENT BETWEEN THE WEAPON AND A RACK MOUNT

CROSS-REFERENCE TO RELATED APPLICATIONS

This application is a Divisional Application of U.S. application Ser. No. 12/606,893 filed on Oct. 27, 2009, now U.S. Pat. No. 8,245,641 issued on Aug. 21, 2012, which claims benefit to U.S. Provisional Application No. 61/109,153 filed on Oct. 28, 2008, the entire contents of each of which is incorporated herein by reference.

BACKGROUND OF THE INVENTION

1. Field of the Invention

The present invention relates generally to small weapon systems, and more particularly, to methods for enabling safe/arm functionality within small weapons.

2. Prior Art

All weapon systems require fuzing systems for their safe and effective operation. A fuze or fuzing system is designed to provide as a primary role safety and arming functions to preclude munitions arming before the desired position or time, and to sense a target or respond to one or more prescribed conditions, such as elapsed time, pressure, or command, and initiate a train of fire or detonation in a munition.

Fuze safety systems consist of an aggregate of devices (e.g., environment sensors, timing components, command functioned devices, logic functions, plus the initiation or explosive train interrupter, if applicable) included in the fuze to prevent arming or functioning of the fuze until a valid launch environment has been sensed and the arming delay has been achieved.

Safety and arming devices are intended to function to prevent the fuzing system from arming until an acceptable set of conditions (generally at least two independent conditions) have been achieved.

A significant amount of effort has been expended to miniaturize military weapons to maximize their payload and their effectiveness and to support unmanned missions. The physical tasking of miniaturization efforts have been addressed to a great extent. However, the same cannot be said regarding ordnance technologies that support system functional capabilities, for example for the case for fuzing.

It is important to note that simple miniaturization of subsystems alone will not achieve the desired goal of effective fuzing for smaller weapons. This is particularly the case in regards to environmental sensing and the use of available stimuli in support of "safe" and "arm" functionality in fuzing of miniature weapon technologies.

A need therefore exists for the development of methods and devices that utilize available external stimuli and relevant detectable events for the design of innovative miniature "safe" and "arm" (S&A) mechanisms for fuzing of gravity dropped small weapons.

SUMMARY OF THE INVENTION

The present methods and devices can utilize power generators which store energy in one or more elastic elements, such as piezoelectric-based energy-generating power sources to power electronics circuitry and logics to assist in "safe" and "arm" (S&A) functionalities and, when desired, other fuzing functionalities. Such piezoelectric-based energy-generating power sources are disclosed in e.g., U.S. Pat. No. 7,312,557, the entire contents of which is incorporated herein by reference. For example, since the piezoelectric element of the energy generator also acts as an accelerometer, its output can be used to detect the time of impact, level of impact force (i.e., detect soft and hard target), the direction of impact, and elapsed time post impact (see for example, U.S. application Ser. Nos. 11/654,090; 11/654,101; 11/654,289; 11/654,110 and 11/654,083 each of which was filed on Jan. 17, 2007 and each of which are incorporated herein by reference in their entirely). The information can then be used to achieve a "smart" and more effective detonation and/or activate a self-destruct sequence of events to minimize collateral damage and significantly reduce the possibility of unexploded ordinance (UXO). The present methods and devices can therefore provide all the advantages of electronics fuzing in a very small volume with passive (no-battery) designs. The present methods and devices also provide additional and very high level of safety since no power is available to the electronics circuitry and to the weapon initiation circuitry prior to the weapon release (deployment) and before a programmed amount of time has elapsed. In addition, with the availability of electronics circuitry, the external stimuli, environmental sensing capabilities and detected events are more effectively measured and utilized to assist in the desired "safe" and "arm" (S&A) functionalities.

Accordingly, a method for enabling safe/arm functionality in weapons is provided. The method comprising: attaching the weapon to an airframe; providing an elastic element in the weapon; releasing the weapon from the airframe to release a stored energy in the elastic element; converting the stored energy to an electrical energy; and providing the electrical energy to one or more components in the weapon.

The step of attaching the weapon to the airframe can comprise attaching one end of a rack to the airframe and another end to the weapon. The step of releasing can comprise moving the weapon relative to the rack. The moving can comprise a sliding movement.

The elastic element can be a spring and the energy is stored in the spring by preloading the spring and retaining the spring in a pre-loaded state. The releasing can release the pre-loaded state. The releasing can produce a vibration in the spring and the converting can comprise attaching an end of the spring to a piezoelectric member, wherein the vibration exerts a pushing and pulling on the piezoelectric member to generate the electrical energy. The spring can further include a mass at another end for facilitating the vibration of the spring.

Also provided is a method for determining one or more of an impact level and direction of a weapon as it strikes a target. The method comprising: providing an elastic element in the weapon; providing a piezoelectric member attached to the elastic element such that elongation and/or depression of the elastic element will generate an electrical power output from the piezoelectric member; and determining the impact level based on the output of the piezoelectric member. The determining can determine the impact level based on a level of peak voltage generated by the piezoelectric member. The providing of the elastic element can comprise providing three or more elastic elements and the providing of the piezoelectric member can comprise providing the piezoelectric member for each of the three or more elastic elements, wherein the direction of the impact is determined based on the output of the piezoelectric members.

Still further provided is a device for enabling safe/arm functionality in weapons. The device comprising: a rack for attaching the weapon to an airframe; an elastic element disposed in the weapon; a releasable connection between the weapon and the airframe to release a stored energy in the elastic element; and a piezoelectric member connected to one end of the elastic member for converting the stored energy to an electrical energy.

One end of the rack can be attached to the airframe and another end can be attached to the weapon.

The elastic element can be a spring and the energy can be stored in the spring by preloading the spring and retaining the spring in a pre-loaded state.

The device can further comprise a mass at another end for facilitating the vibration of the spring.

The releasable connection can comprise an outer housing connected to the rack and an inner housing connected to the weapon, the inner and outer housing being movable relative to each other. The inner housing can contain the elastic element and piezoelectric member. The inner housing can further comprise a mass connected to another end of the elastic element.

One of the inner or outer housings can include one or more retainer members for maintaining the elastic member in a preloaded state such that the one or more retainer members are released due to the releasing of the weapon from the rack. The device can further comprise a mass at another end for facilitating the vibration of the spring and the mass can include one or more tapered surfaces for facilitating release of the retainer members.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Figure 1:
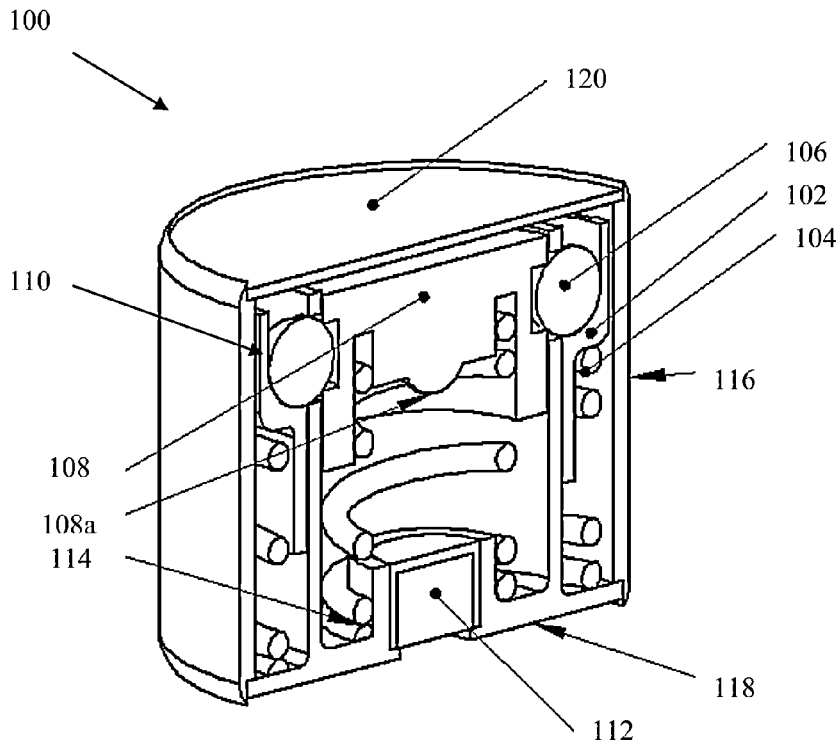
FIGURE 1 (PRIOR ART)
FIGS. 1 and 2 illustrate cut-away views of a miniaturized inertial igniter as shown in U.S. Pat. No. 7,437,995, the entire contents of which are incorporated herein by reference.
Figure 2:
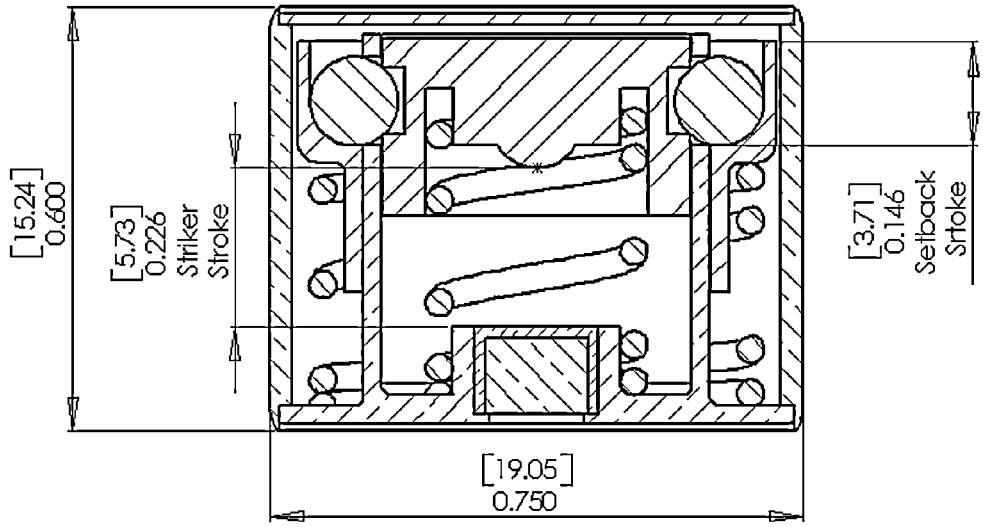
FIGURE 2 (PRIOR ART)

A schematic of a miniature inertial igniter 100 as described in U.S. Pat. No. 7,437,995 is shown in FIGS. 1 and 2. Briefly, it consists of a setback collar 102 that is supported by a setback spring 104. The setback collar 102 is biased upward, thereby preventing setback locking balls 106 from releasing a striker mass 108. The setback collar 102 is provided with a deep enough upper lip 110 to allow certain amount of downward motion before the setback locking balls 106 could be released. The spring rate of the setback spring 104, the mass of the setback collar 102 and the height of the aforementioned upper lip 110 of the setback collar 102 determines the level of no-fire G level and duration that can be achieved. Under all-fire condition, the setback collar 102 moves down, thereby releasing the setback locking balls 106 which secure the striker mass 108, allowing them to move radially outward, thereby releasing the striker mass 108. The striker tip 108*a* is then free to move against the biasing force of a striker spring 114 and under the influence of the remaining acceleration event toward its target, in this case a percussion cap primer 112. The components of such inertial igniter are housed in a casing, such as the one illustrated in FIG. 1 having a housing tube 116, igniter body 118 and top cover 120.

Another novel class of mechanical inertial igniters is disclosed in U.S. Pat. No. 7,587,979 and shown in FIG. 3. In this class of inertial igniters, a novel method is employed to develop highly compact and long delay time mechanical mechanisms for miniature mechanical inertial igniters. The method is based on a "domino" type of sequential displacement or rotation of inertial elements to achieve very large total displacements in a compact space. In this process, one inertial element must complete its motion due to the imparted impulse before the next element is released to start its motion.

This process is especially effective in reducing the required length (angle) of travel of the inertial elements since the distance traveled due to an applied acceleration is related to the square of the travel time. Therefore by providing sequences of small displacements that begin from zero initial velocities as is the case for this class of mechanical time delay mechanisms, one can obtain relatively long delay times with very limited sequences of small displacements. The igniter shown in FIG. 3 is approximately 5 mm wide, 8.5 mm long and 3 mm high; representing a 90% reduction in size as compared to previously available inertial igniters.

Figure 3:
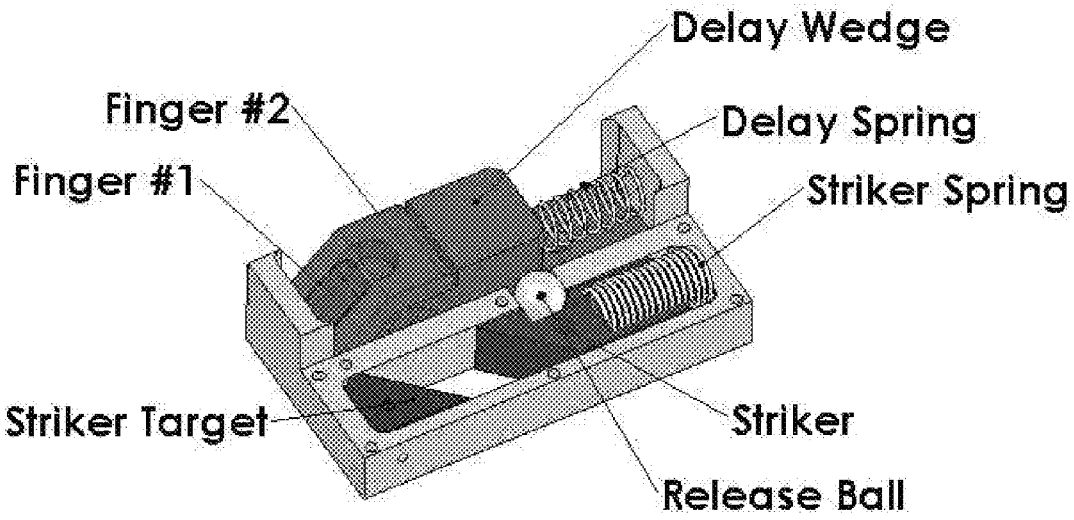
FIGURE 3 (PRIOR ART)
FIG. 3 illustrates a cut-away view of a multi-stage inertial igniter as shown in U.S. Pat. No. 7,587,979, the entire contents of which are incorporated herein by reference.

The class of igniters as shown in FIG. 3 do not require external power sources (no-batteries or external powering), and are equipped with electronics circuitry and logics that are programmable to adjust to the desired no-fire and all-fire requirements and set the desired ignition time delay, thereby allowing to meet multiple predefined no-fire and all-fire environments to satisfy the requirements of different types of ordnances.

The class of electrically initiated inertial igniters as shown in FIG. 3 is particularly of interest since it is totally passive, i.e., does not require a battery or any external power source; its electrical power is self-generated; and uses electronics circuitry and logics to achieve functions very similar to the desired "safe" and "arm" functionalities. It is noted, however, that the source of inertial igniter self-powering is the setback acceleration, while as is discussed below, the source of self-powering in the proposed "safe" and "arm" device electronics circuitry and logics is the motion of the weapon as it is released from the airframe.

Figure 4:
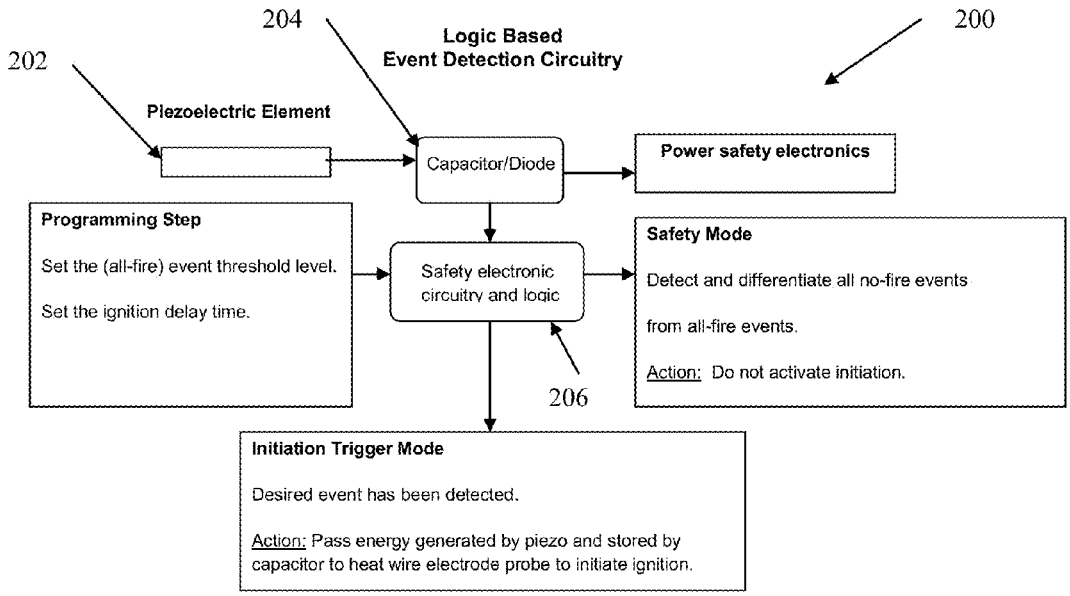
FIG. 4 illustrates a block diagram of a class of piezoelectric element based programmable electrically initiated inertial igniters.

The block diagram for the class of programmable electrically initiated inertial igniters of FIG. 3 is shown in FIG. 4. The device 200 uses an appropriately sized piezoelectric element 202, which responds to axial accelerations and decelerations of the munitions. The developed charge (electrical energy) by the piezoelectric element 202 is proportional to the applied acceleration level (opposite sign for deceleration). As a result, the sign of the corresponding voltage on the piezoelectric element 202 would readily indicate the direction of the axial acceleration that is applied to the munitions due to the firing or accidental dropping or other similar no-fire conditions.

However, the detection of the generated voltage levels alone is not enough to ensure safety in gun-fired munitions. This is the case since in certain accidental events such as direct dropping of the igniter, thermal battery and/or the munitions, the acceleration levels that are experienced by the igniter may be well above that of the specified all-fire acceleration level requirements. For example, when an igniter is dropped over a hard surface, it might experience acceleration levels of up to 2000 Gs for an average duration of up to 0.5 msec. However, the all-fire acceleration level may be significantly lower, for example around 500 Gs, with the difference being in its duration, which may be around 8-15 msec. In addition, very long term vibration type oscillatory accelerations and decelerations but at relatively low levels may be experienced during transportation or the like. It is therefore evident that the voltage levels experienced by active elements such as piezoelectric elements alone, or total accumulated generated energy due to vibration over relatively long periods of time cannot be used to differentiate no-fire conditions from all-fire conditions in all munitions. Thus, the device must also differentiate between low amplitude and long term acceleration profiles due to vibration and all-fire acceleration profiles.

In the class of igniters as shown in FIG. 3, the charge generated by the piezoelectric element is used to power the detection and safety electronics and logic circuitry as well as the detonation capacitor and its activation circuitry. The energy from the piezoelectric element 202 is stored in a separate and relatively small capacitor 204 that acts as a controlled power source to power the logic circuit 206. This external power, supplied by the charged capacitor, is used to activate the monitoring circuit logic to provide functionality, allowing for a range of triggering events to be detected from the piezoelectric element that are not directly coupled to peak voltage or energy detection of the piezoelectric element. In this way, a circuit can be designed to prevent detection of momentary spike voltage that could be accidentally generated by random vibrations or accidental droppings or other similar accidental events, indicating a false ignition condition.

Figure 5:
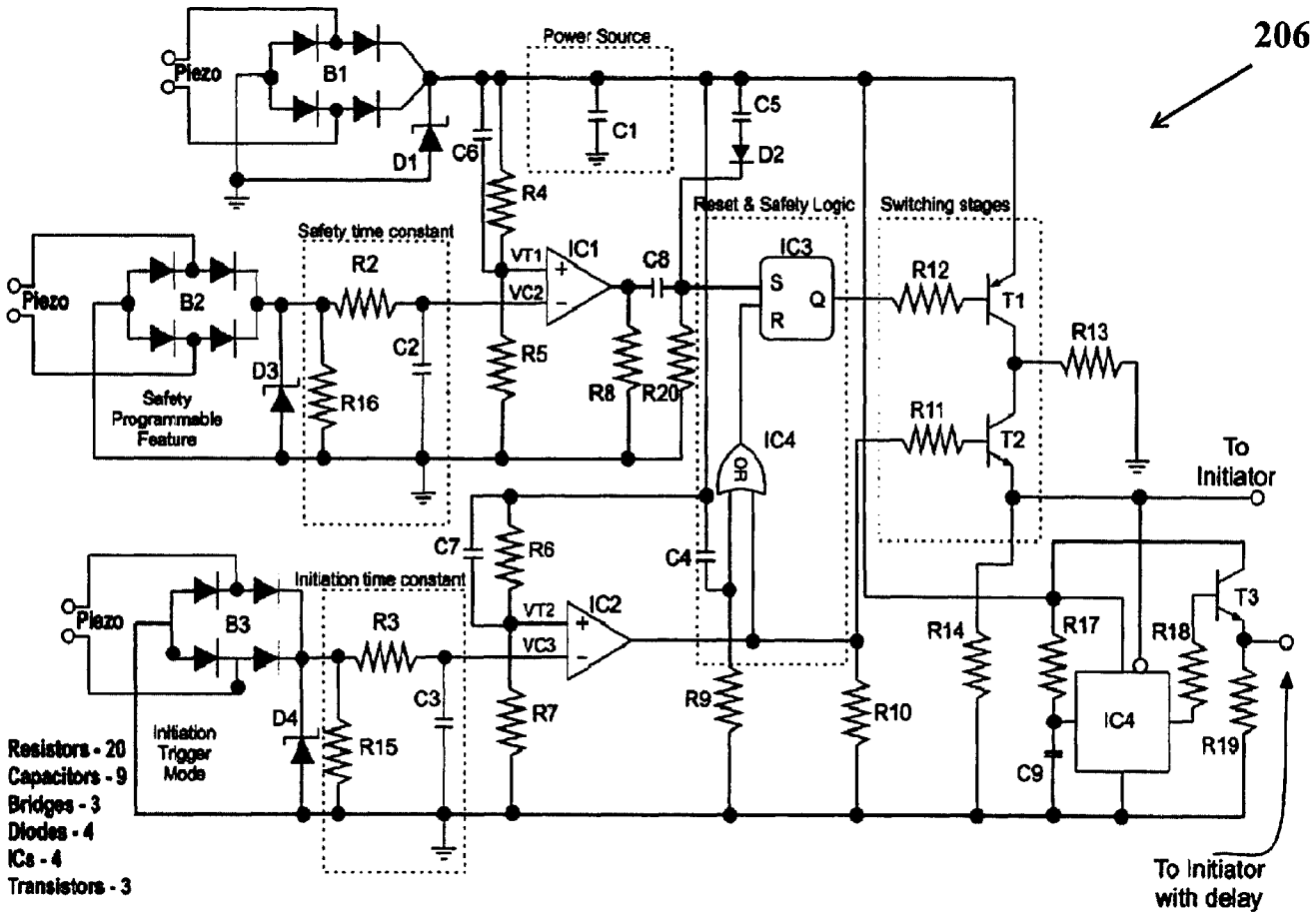
FIG. 5 illustrates a piezoelectric powered programmable event detection and logic circuitry design for differentiating all no-fire events from all-fire events and to initiate igniter with a programmed time delay following all-fire event detected.

One electronics circuitry and logic 206 option is shown in FIG. 5. This option includes functionality enhancement for safety with an integrated capability to delay the initiation signal by a selected (programmed) amount of time, which could be in seconds and even minutes.

In this design option, power stored in power supply capacitor C1 is harvested from the piezoelectric element 202 and rectified by the bridge rectifier Bl. The voltage at C1 rises to the operational value and it is now ready to start powering the electronics. During the transitional state the comparator IC1 and IC2, and the OR gate is reset to its desired output value. Capacitors C6 and C7, stabilize and reset IC1 and IC2, respectively, and capacitor C4 resets the IC3, which ensures that switching transistor T1 is ready for operation. A capability that is provided by this design option relates to the safe operation of the rectified output of the piezoelectric elements 202 at the bridge rectifiers output. Diodes D1, D3 and D4 are clamping and transient suppression diodes. These devices ensure that high transient values of voltages produced by the piezoelectric elements 202 do not reach the electronic circuits.

In the event detection and logic circuitry option of FIG. 5, a programmable time delay capability to delay the signal to initiate the igniter has also been incorporated. In this circuitry design option, IC4, the resistor R17 and the capacitor C9 provide the time constant for the output of IC4 at R18 to provide a delayed output to the igniter initiator circuit. This circuitry offers for both non-delayed as well as delayed output depending on the application.

An initial list of environmental sensing and event detection possibilities that could potentially be used as practical means to achieve "safe" and "arm" (S&A) functionalities within the context of small ordnance applications are now described.

The methods and devices disclosed herein for the implementation of the present "safe" and "arm" (S&A) functionalities is passive, i.e., does not require a battery or external means of powering; is powered by generators, such as piezoelectric-base power generators; employs simple electronics circuitry and logics to assist "safe" and "arm" (S&A) functionalities and, if desired, fuzing functionalities. The overall packaging of such electronics and power generation devices can be very small and very low cost.

In general, the following environmental sensing and event detection possibilities are suitable for most large and small gravity dropped weapons:

1. The event of releasing the weapon from the air vehicle (manned or unmanned), from any possible altitude. This event, through any existing mechanical disengagement mechanism, can provide for "safing" functionality through an appropriate mechanical mechanism. Depending on the weapon to airframe attachment method, different means such as simple arming wire may provide for this functionality.

2. Detection of the power levels generated by the proposed piezoelectric-based power generator, which indicates the amount of time elapsed from the time of weapon release. The detection of the electrical energy levels in the electronics circuitry capacitor provided for this purpose ensures the elimination of all accidental events such as dropping of the weapon, extreme vibration levels, or the like from weapon release event.

3. The electronics circuitry and logics that is powered by the proposed piezoelectric-based power generators can readily measure elapsed time post weapon release. This time measurement can be "programmed" to indicate certain elapsed times, which are then used for "safe" and "arm" (S&A) functionalities as well as fuzing delay functionalities (can also be combined with other external event detections such as target impact—or lack of significant impact force over an appropriately long period of time for functionalities such as self-destruct-fuze).

4. Detection of "zero gravity" over a long enough period of time to differentiate the event from events such as certain flight maneuvers. This event detection may be used for relatively high altitude gravity dropped weapons. Very simple and miniature suspended mass switching devices can be used to detect "zero-gravity" event.

5. The piezoelectric element of the power generators can also act as pure accelerometers (their peak voltage being proportional to the level of impact force experienced by the weapon as it impacts the target). The dynamic response of piezoelectric elements is very high and suitable for impact level and duration measurement (can readily measure impact force levels applied over small time durations of even less than 0.1 msec). The piezoelectric elements developed as power generators can also be used to measure not only the impact force and its duration but also the direction of the resultant impact force, effectively acting as tri-axial accelerometers. Such information can readily be used not only for "safe" and "arm" (S&A) functionalities but also to achieve highly "smart" fuzing capabilities and UXO and collateral damage reduction.

6. Depending on the type of gravity dropped weapon, a sensor such as the aforementioned suspended mass "zero-gravity" detection device can be used to detect free-falling motions such as the generally induced spin and spin rates, in-flight drag-lift interaction induced wobbling motions, vibrations etc.

7. For weapons dropped from relatively high altitudes, changes in the ambient pressure (and possibly temperature—depending on the release altitude) can be readily used for "safe" and "arm" (S&A) functionality.

It is noted that the above list is by way of example only and is by no means exhaustive and possibly not all applicable to every small gravity dropped weapon.

Figure 6:
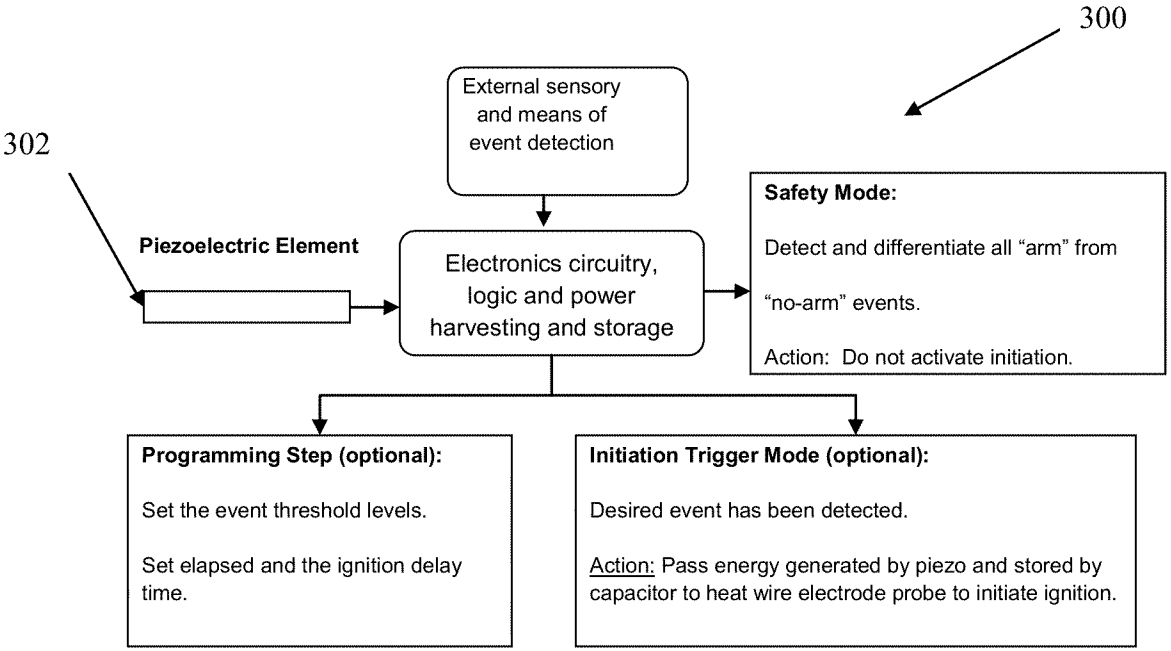
FIG. 6 illustrates a block diagram of a class of proposed piezoelectric-based powering and "programmable" electronics circuitry and logics for providing "safe" and "arm" and fuzing (optional) functionality in small gravity dropped weapons.

A block diagram of a proposed device 300 to provide "safe" and "arm" (S&A) functionalities as well as certain fuzing functionalities (if desired) is shown in FIG. 6. In the block diagram of FIG. 6, a detonation step is also provided for the sole purpose of indicating how a fuzing functionality such as detonation of initiation charges can be achieved.

The device uses a piezoelectric-based power generator (described below), which begins to generate power once the weapon has been released. The piezoelectric element 302 of the power generator 300 can be pre-loaded to prevent it from generating a significant amount of energy that could otherwise power the device electronics as a result of accidental dropping or accidental release. The piezoelectric-based power generator provides an AC voltage with the frequency of vibration of its mass-spring elements, with a typical range of 100-1000 Hz, which can also be used to count the elapsed time post release. By using an appropriately stacked piezoelectric element, almost any peak voltage levels (from a few Volts to 100 Volts or more) could be achieved.

The electronics circuitry and logics of the present device can be similar to the circuitry shown in FIG. 5 (with appropriate modifications to match the specific requirements of the present small gravity dropped weapons). It is noted that the circuitry, as can be seen in the schematic of FIG. 5, can work without the need for microprocessors since the same would add a significant amount of complexity to the device. However, there is no reason why microprocessors could not be employed and additional software controls could not be added, particularly for larger gravity dropped weapons.

The piezoelectric generator powered electronics circuitry and logics can use the aforementioned external stimuli and environmental sensory input and event detection capabilities to provide the desired "safe" and "arm" (S&A) functionalities and optional fuzing functionalities, similar to those described for the electrically initiated inertial igniters (FIGS. 4 and 5). These "safe" and "arm" (S&A) functionalities are in addition to those provided by means such as pulling of arming wires, etc. (if present). In a similar manner, the energy from the piezoelectric element is envisioned to be stored in a relatively small capacitor that would act as a controlled power source to power the electronics and logics circuitry. This external power, now supplied by the charged capacitor, would be used to activate the monitoring circuit logic to provide functionality, allowing for a range of triggering events to be detected from the piezoelectric element as well as the external sensory inputs. In this way, a circuit can be designed to safely prevent detection of momentary spike voltages such as electrical discharges that could be accidentally generated or even by random vibrations or accidental droppings or other similar accidental events, from being mistaken for a S&A condition.

Methods and devices for generating electrical energy as the weapon is released from the aircraft is next described. Here, it is assumed that the weapon is released by sliding through a release rack. Such rack is attached to both the aircraft and the weapon and can be released from the weapon by any means known in the art, such as the sliding release or a pulling away release. The below concepts are also adoptable for pin release drops with minor modification since the mechanism of disengaging the energy generating mass-spring element(s) is achieved via a simple and small relative motion of the weapon relative to the rack (and airframe structure attached thereto). It is noted that the disclosed power generators can also be adapted to produce electrical energy from aerodynamically induced vibration and oscillatory motions of the weapon (when applicable, particularly for high altitude dropped weapons) by providing them with well known sources of aerodynamically induced vibration.

Figure 7A:
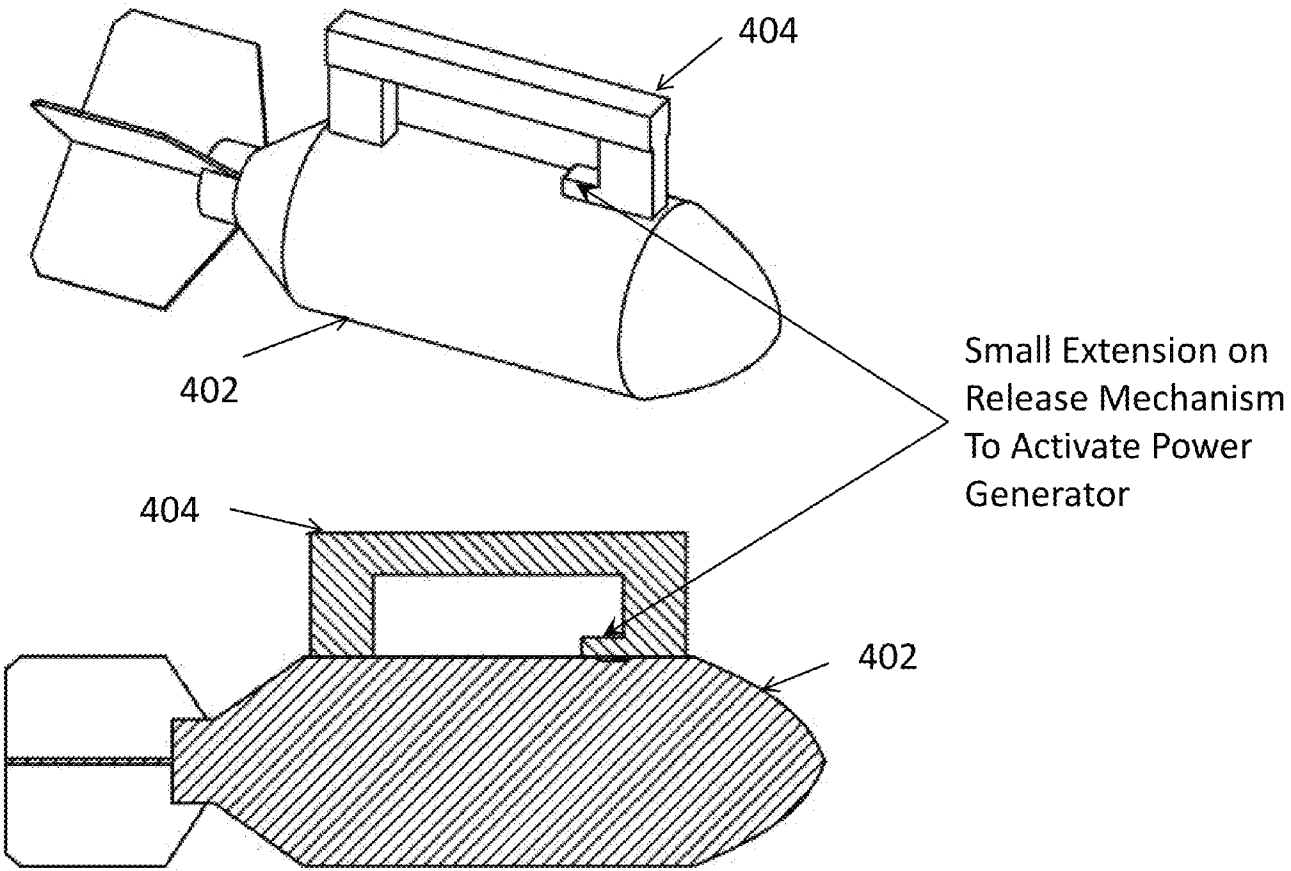
FIGS. 7A and 7B illustrate a first embodiment for of a piezoelectric-based power generator.
Figure 7B:
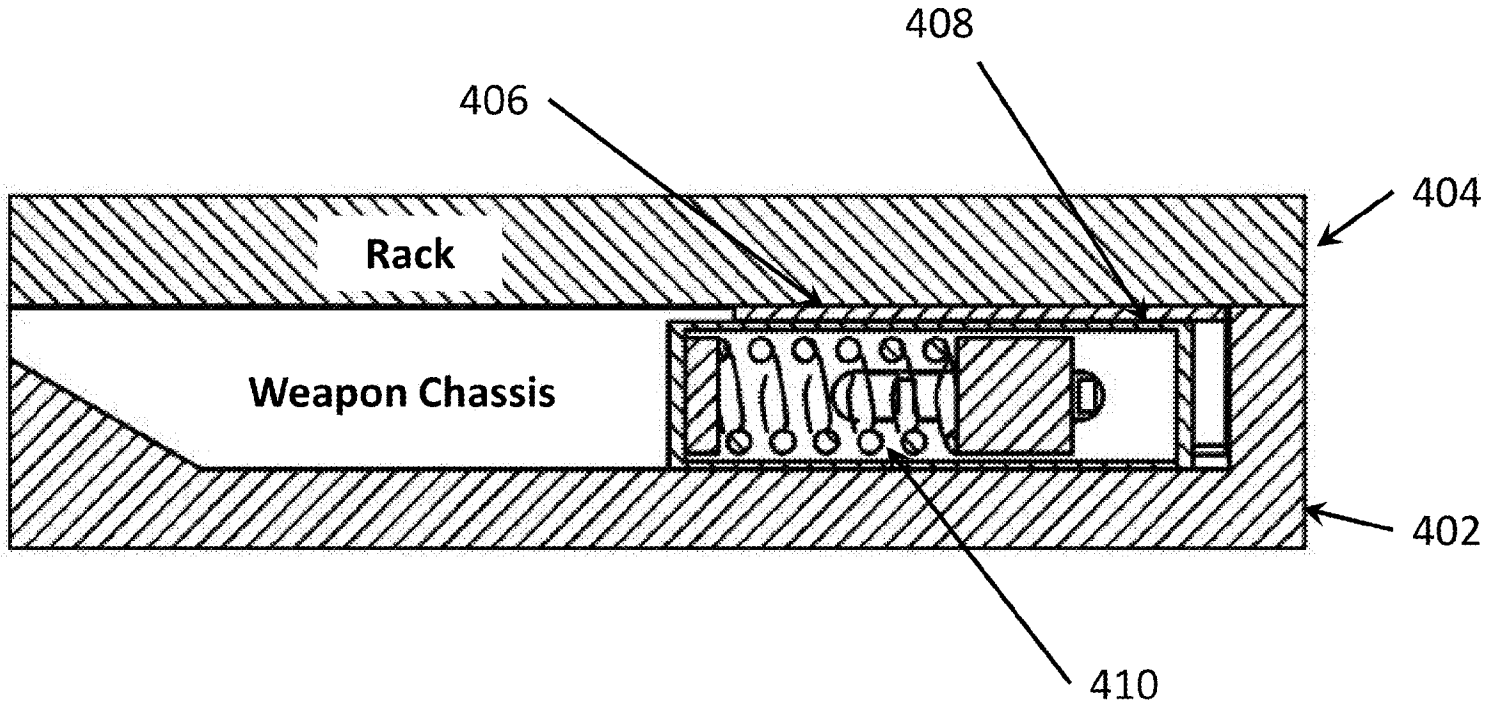

The schematic of a first piezoelectric-based power generation concept for small gravity dropped weapon is shown in FIGS. 7A and 7B. The power generator 400 is shown to be positioned in the weapon at an interface between the weapon chassis 402 and the airframe rack 404. In the close-up cutaway view (FIG. 7B) one concept option is shown, with more details shown in FIGS. 8A, 8B and 9. The generator assembly consists of an outer housing 406, which is attached to the airframe rack 404. An inner housing 408 of the generator is attached to the weapon chassis 402.

Figure 8A:
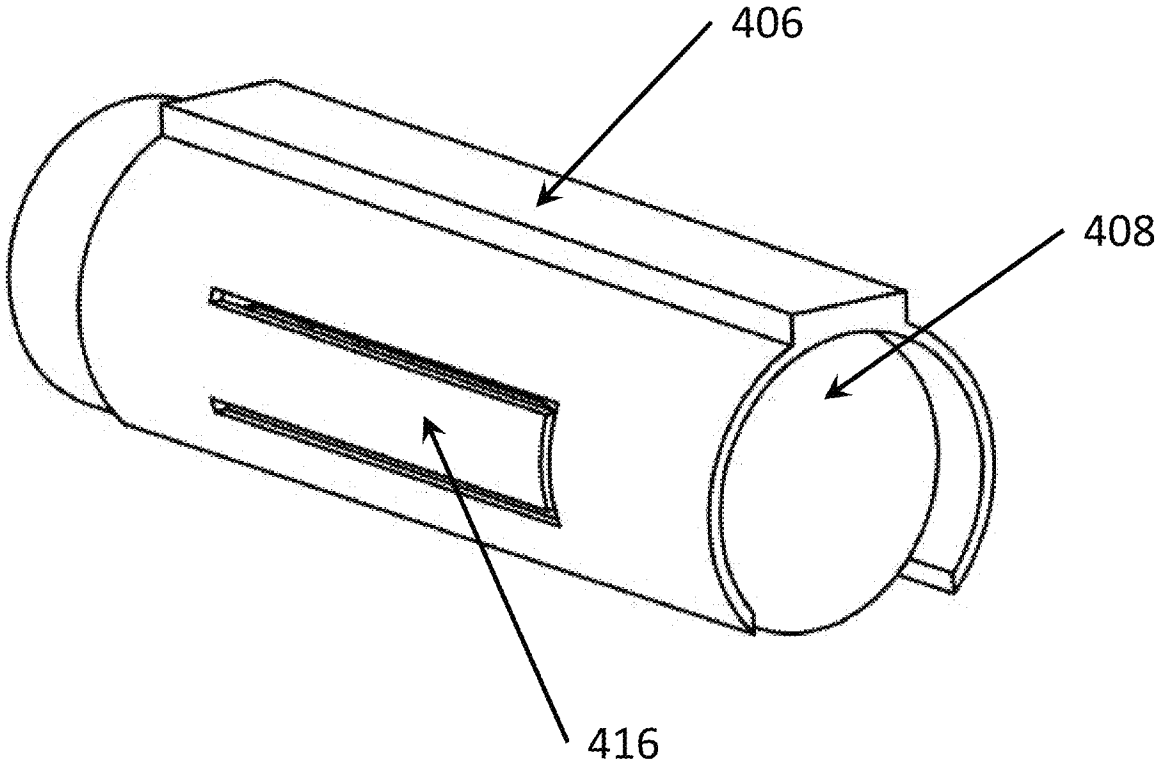
FIGS. 8A and 8B illustrate the inner and outer housings of the piezoelectric-based power generator (shown assembled in FIG. 8A and disengaged in FIG. 8B).
Figure 8B:
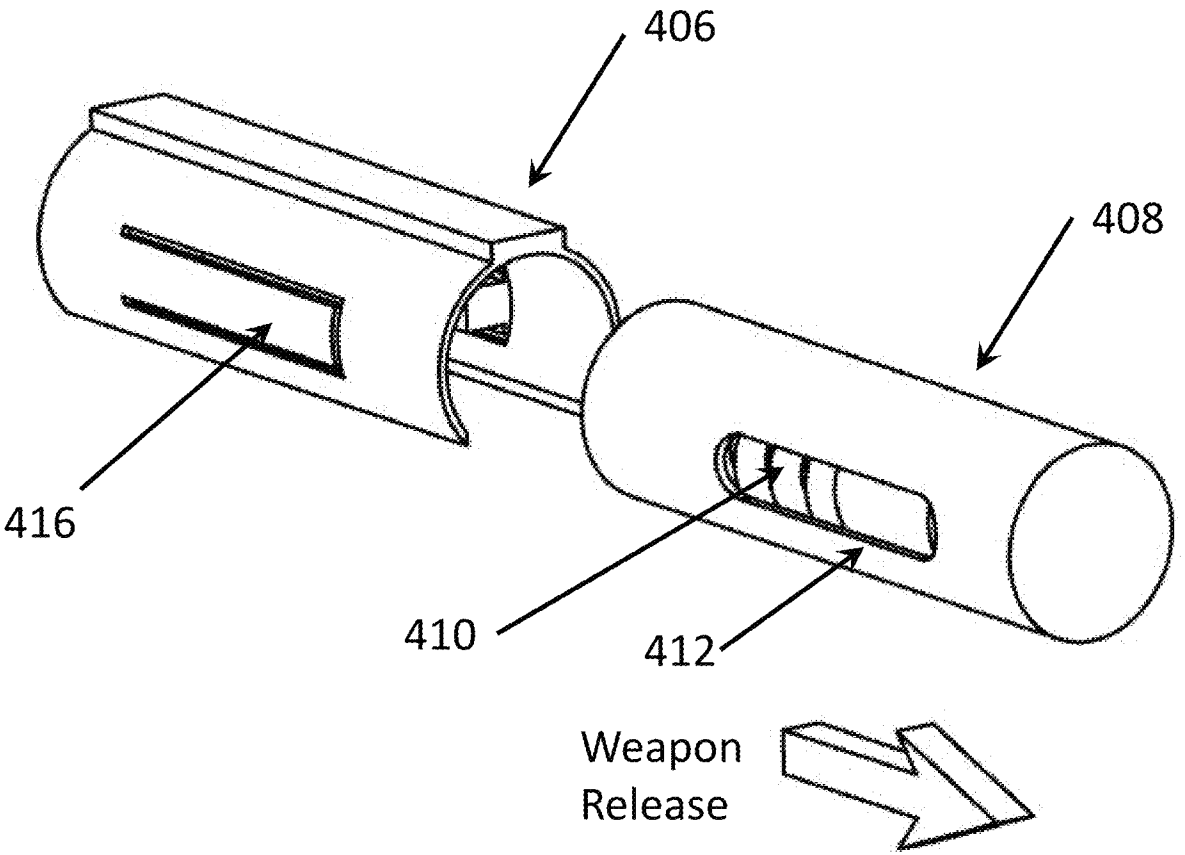

The inner housing 408 is provided with a slot 412 to allow the generator spring-mass element 410 to be preloaded (i.e., its spring to be initially compressed) as the weapon is released in the direction of the arrow (FIG. 8B). During the release, the inner housing 408 slides out of the outer housing 406 in the direction of the arrow (to the right in FIG. 9). A generator having energy stored in an elastic element, such as the mass-spring unit 410, is not loaded (deformed) prior to weapon release. The elastic element, such as spring element 410*a* can be attached to a mass 410*b* on one end and to a piezoelectric element, such as a piezoelectric stack assembly 302 (details not shown for clarity) at the other end. As the inner housing 408 moves out of the outer housing 406, the "keeper tabs" 414 of the two side flexures 416 (FIG. 8A) causes the spring element 410*a* to be compressed, thereby causing certain amount of potential energy to be stored in the spring element 410*a*.

Figure 9:
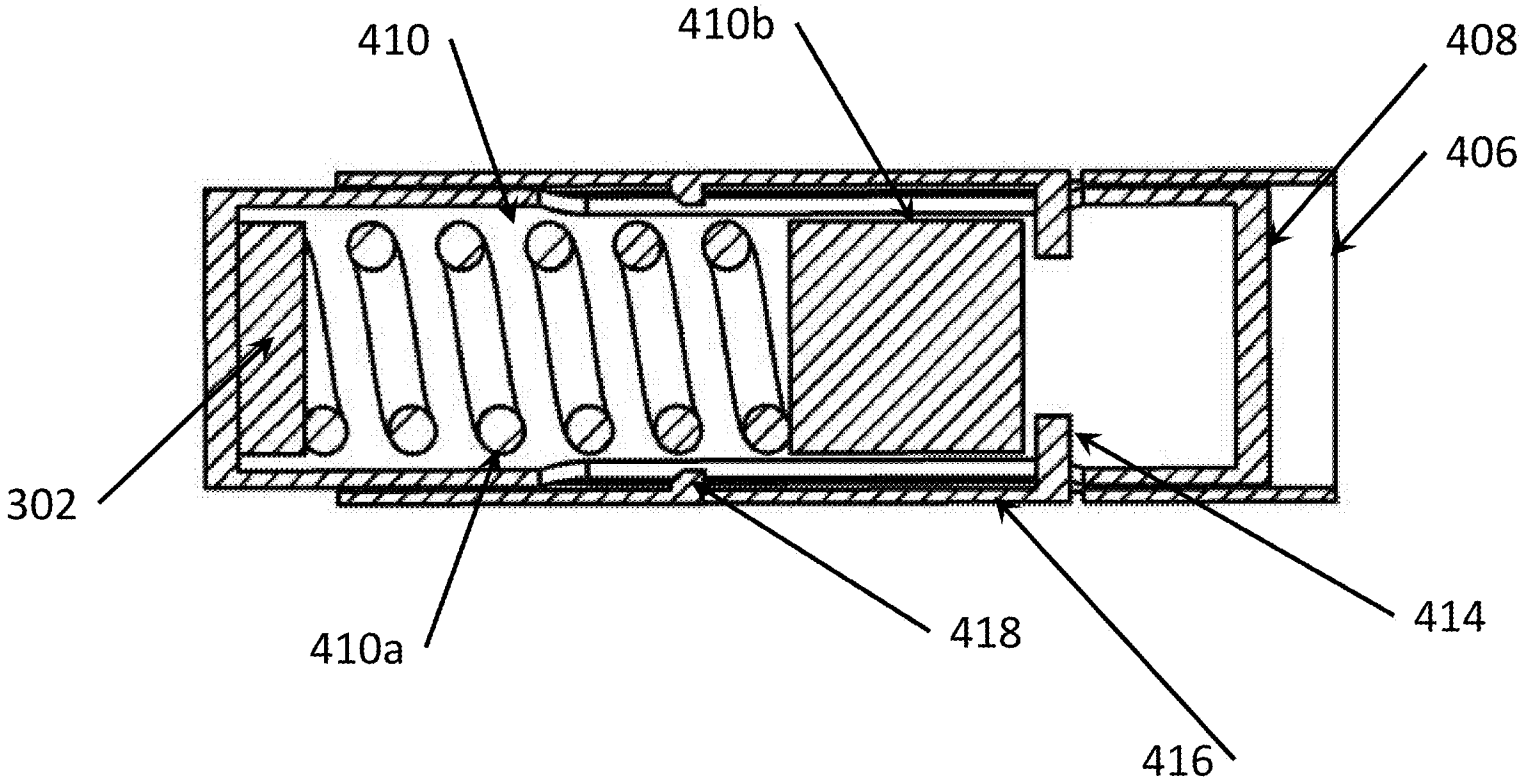
FIG. 9 illustrates a sectional view of the piezoelectric-based power generator of FIG. 8A.
Figure 10B:
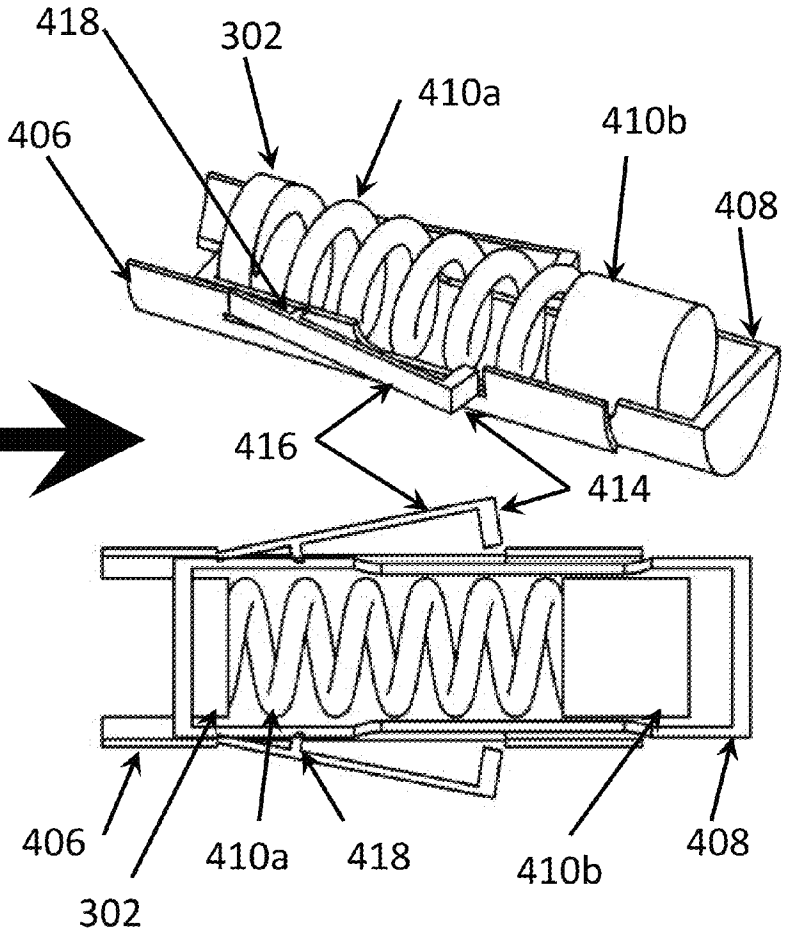
FIGS. 10A and 10B each illustrate cut-away perspective and plan views of the piezoelectric-based power generators of FIGS. 8A and 8B in which the mass-spring unit is retained (FIG. 10A) and released (FIG. 10B).
Figure 10A:
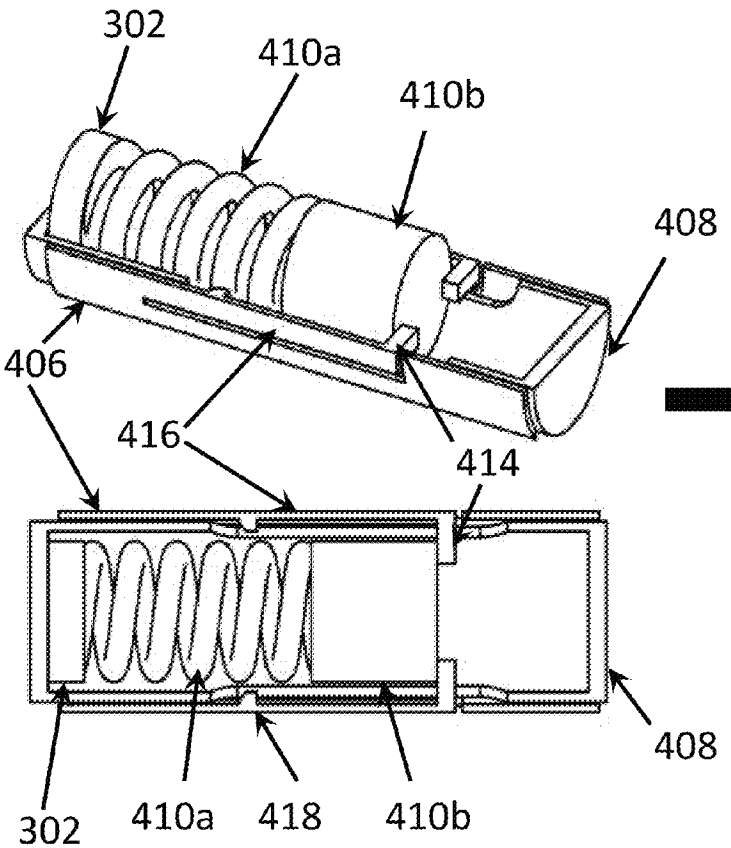

Then as the inner housing 408 moves further out of the outer housing 406, at some point the inner housing 408 begins to push on the "release tab" 418 (FIG. 9), thereby begins to push the "spring keepers" 416 to the side (radially outward), thereby begins the process of releasing the mass-spring unit 410 of the power generator (see also the 3D and frontal views shown in FIG. 10B). Further movement of the inner housing 408 pushes the spring keepers 416 to the side and releases the mass-spring unit 410 to begin to vibrate in the direction of the indicated arrows (FIG. 10A). The vibration of the spring-mass unit 410 generates a cyclic force on the piezoelectric stack 302, thereby causing it to generate a cyclic charge (within a planned voltage), which is then harvested by the device electronics (for example, as shown in FIG. 5). The generator will keep vibrating until the mechanical potential energy that was stored in the spring element 410*a* is converted to electrical energy over a certain period of time, depending on the frequency of vibration of the mass-spring element 410, the size of the piezoelectric element 302 (i.e., the amount of energy that it extracts from the system during each cycle of its vibration) and the efficiency of the energy harvesting electronics.

Figure 11A:
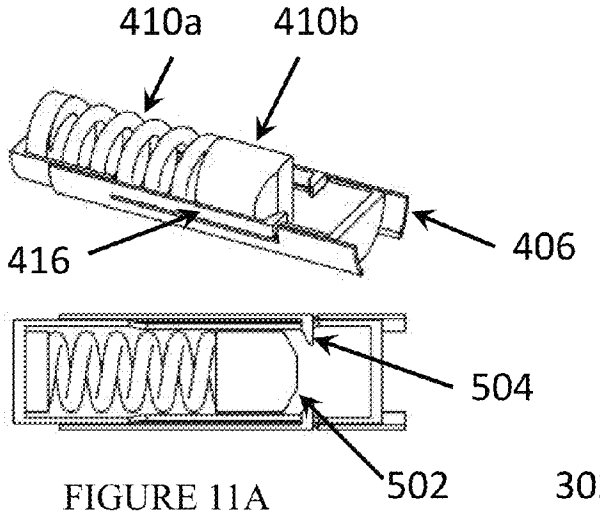
FIGS. 11A, 11B, 11C and 11D illustrate each illustrate cut-away perspective and plan views of a second embodiment of a piezoelectric-based power generator for small gravity dropped weapons.
Figure 11B:
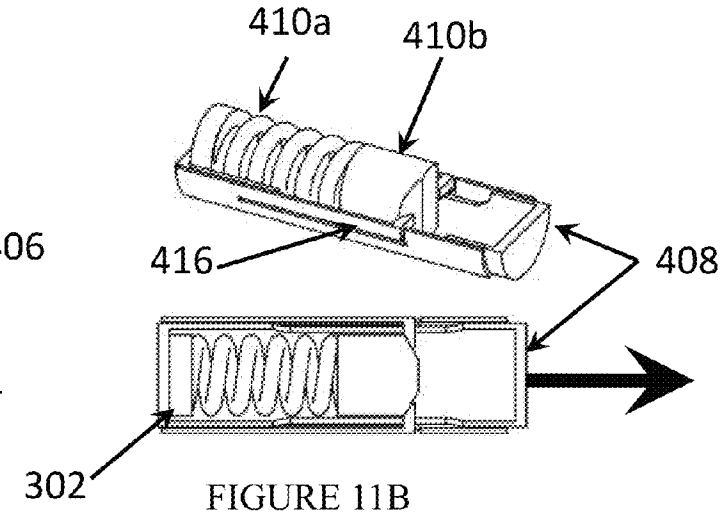
Figure 11C:
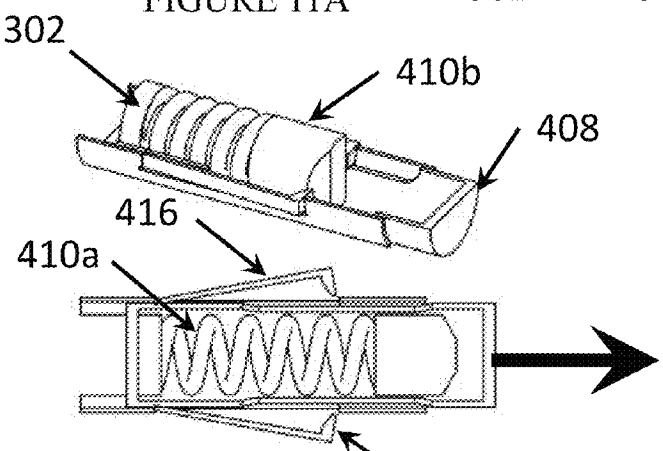
Figure 11D:
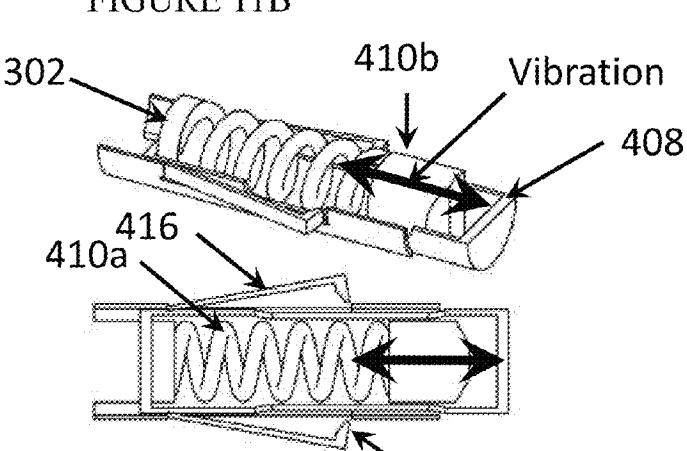

The schematic of a second piezoelectric-based power generation device for small gravity dropped weapon is shown in FIGS. 11A-11D. This design is similarly packaged with an outer housing 406 an inner housing 408 as shown in FIGS. 8A, 8B and 9, which are attached to airframe rack 404 and weapon chassis 402, respectively, as shown in FIG. 7B. The main difference between this and the previous concept is the method of releasing compressed spring-mass unit 410 as the weapon release motion proceeds. In the device shown in FIGS. 11A-11D, no release tab (418—FIG. 9) is provided on the "spring keeper" (FIG. 8B). Instead, the mass element 410*b* is provided with beveled sections 502 that engage opposing beveled sections 504 on the keeper tabs 414, and as the pressure exerted by the spring 410*a* increases while the inner housing 408 is moved out of the outer housing 406 during the weapon release process, the keeper tabs 414 are pressured to the sides, FIGS. 11B-11C, thereby freeing the mass-spring element 410 to begin to vibrate as shown in FIG. 11D. Electrical energy is then generated as was described for the previous generator.

It is noted that the configurations discussed above for the piezoelectric-based power sources are provided by way of example only. It is also noted that as an example, the electronics circuitry and logic shown in FIG. 5 requires around 10-15 mJ (including 4 mJ of energy for detonation of the initiation charge) of electrical energy that could be readily provided in a power generator package of around 10 mm in diameter and 10-12 mm long.

It is also noted that as the weapon impacts a target, the deceleration rate that it experiences will also cause the spring element of the power generators shown in FIGS. 7A-11D to extend (or compress if the generators are mounted in the opposite direction of those shown in FIGS. 8A-11D). The level of peak voltage generated by the piezoelectric element will then indicate the level of impact force that is experienced, i.e., the softness and hardness of the impacted target. In addition, by using 3 or more piezoelectric elements in the piezoelectric generator unit assembly (occupying the same amount of relative volumes as shown in FIGS. 8A-11D), the distribution of impact force over the surface of the piezoelectric generator unit, thereby the direction of the impact force can be determined.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A device for enabling safe/arm functionality in a gravity dropped weapon, the device comprising:

a rack for releasably attaching the weapon to an airframe;

a generator disposed in the weapon such that a first portion of the generator is attached to the weapon and a second portion of the generator is attached to the releasable rack, the generator having an elastic element that is preloaded to store potential energy therein;

a releasable connection between the weapon and the rack that separates the first and second portions to thereby release the stored energy in the elastic element such that the elastic element vibrates; and a piezoelectric member connected to one end of the elastic member for converting the vibration of the elastic element to an electrical energy.

2. The device of claim 1, wherein the elastic element is a spring and the spring is retained in a pre-loaded state.

3. The device of claim 1, further comprising a mass at another end for facilitating the vibration of the spring.

4. The device of claim 1, wherein the releasable connection comprises an outer housing connected to the rack and an inner housing connected to the weapon, the inner and outer housing being movable relative to each other.

5. The device of claim 4, wherein the inner housing contains the elastic element and piezoelectric member.

6. The device of claim 5, wherein the inner housing further comprises a mass connected to another end of the elastic element.

7. The device of claim 4, wherein one of the inner or outer housings includes one or more retainer members for maintaining the elastic member in a preloaded state such that the one or more retainer members are released due to the releasing of the weapon from the rack.

8. The device of claim 7, wherein the device further comprises a mass at another end for facilitating the vibration of the spring and the mass includes one or more tapered surfaces for facilitating release of the retainer members.

* * * * *